United States Patent [19]

Matsui

[11] 4,226,180

[45] Oct. 7, 1980

[54] TYPE SEPARATOR IN A HAMMER ACTUATED PRINTER

[75] Inventor: Hirotoshi Matsui, Shiki, Japan

[73] Assignee: Sharp Kabushiki Kaisha, Osaka, Japan

[21] Appl. No.: 880,092

[22] Filed: Feb. 22, 1978

[30] Foreign Application Priority Data

Feb. 22, 1977 [JP] Japan ..... 52-21661[U]

[51] Int. Cl.[3] ..... B41J 1/20; B41J 9/38; B41J 27/12

[52] U.S. Cl. ..... 101/111; 101/105; 400/146

[58] Field of Search ..... 40/146, 145.2; 101/105, 101/110, 111

[56] References Cited

U.S. PATENT DOCUMENTS

| | | | |
|---|---|---|---|
| 110,864 | 1/1871 | Norton | 101/110 |
| 369,401 | 9/1887 | Enjalbert | 400/145.2 |
| 636,524 | 11/1899 | Ham | 101/111 |
| 772,337 | 10/1904 | Brown | 101/110 |
| 1,641,238 | 9/1927 | Schievenbeck | 101/111 |
| 3,661,076 | 5/1972 | Berger | 101/111 |
| 3,805,696 | 4/1974 | Tsuji | 101/110 |

FOREIGN PATENT DOCUMENTS

| | | | |
|---|---|---|---|
| 2557876 | 7/1976 | Fed. Rep. of Germany | 101/110 |
| 479401 | 3/1916 | France | 101/75 |

*Primary Examiner*—Clyde I. Coughenour
*Attorney, Agent, or Firm*—Birch, Stewart, Kolasch & Birch

[57] ABSTRACT

The present invention is directed to a hammer actuated printer comprising a printing drum, a plurality of type carrying belts secured around the printing drum, and a plurality of hammers for depressing a paper toward a selected type carried on the type carrying belts. A plurality of separator strips are formed on the printing drum surface for separating the type carrying belts from each other. The separator strips have a height higher than that of the types carried by the type carrying belts, thereby precluding the paper from coming in contact with types which are not selected.

3 Claims, 5 Drawing Figures

TYPE SEPARATOR IN A HAMMER ACTUATED PRINTER

BACKGROUND AND SUMMARY OF THE INVENTION

The present invention relates to a hammer actuated printer which includes a plurality of type carrying belts secured around a printing drum.

The present invention relates, more particularly, to a construction of a printing drum for securing a plurality of type carrying belts in a hammer actuated printer.

Generally, the hammer actuated printer comprises a printing drum, a plurality of type carrying belts secured around the printing drum, and a plurality of hammers for depressing a paper toward a selected type carried on the type carrying belts. An ink roller is provided for covering the types with ink. The ink roller supplies ink to every type without regard to the selection of the types and, therefore, there is a possibility that the ink may be accidentally deposited on the paper by types which are not selected for printing purposes.

Accordingly, an object of the present invention is to provide a hammer actuated printer which ensures stable operation.

Another object of the present invention is to provide a printing drum suited for performing an accurate printing operation in a hammer actuated printer including a plurality of type carrying belts secured around the printing drum.

Still another object of the present invention is to simplify a hammer actuated printer including a plurality of type carrying belts secured around a printing drum.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

To achieve the above objects, pursuant to an embodiment of the present invention, a plurality of separator strips are formed on a printing drum surface for separating the type carrying belts from each other. The separator strips are preferably integral with the printing drum and have a height higher than that of the types carried by the type carrying belts, thereby precluding the paper from coming into contact with types which are not selected for printing purposes.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DESCRIPTION OF THE PREFERRED EMBODIMENTS

Figure 1:
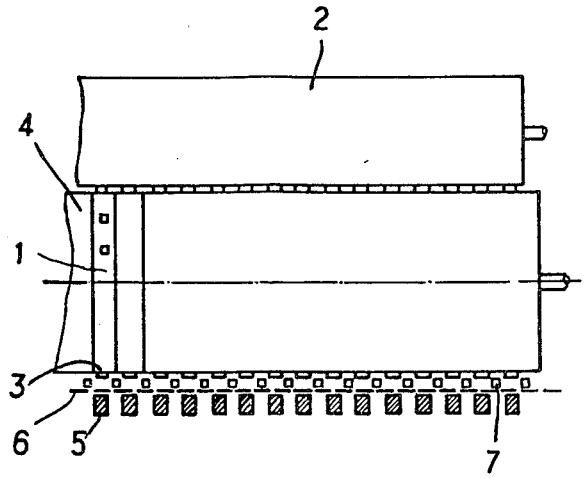
FIG. 1 PRIOR ART
FIG. 1 is a plan view of an essential part of a hammer actuated printer of the general construction.
Figure 2:
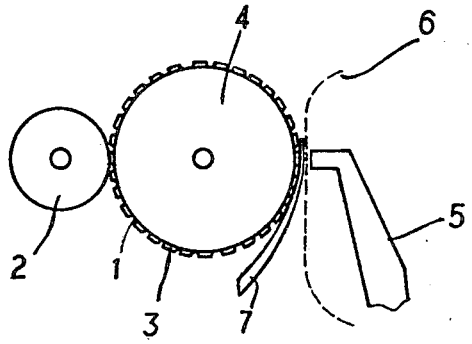
FIG. 2 PRIOR ART
FIG. 2 is a side view of the hammer actuated printer of FIG. 1.

FIGS. 1 and 2 show a conventional hammer actuated printer.

A plurality of type carrying belts 1 are secured on a printing drum 4 by a desired digit number. A plurality of types 3 are carried by the respective type carrying belts 1 and come into contact with an ink roller 2 for covering the types 3 with ink. A plurality of hammers 5 are provided by the desired number at positions corresponding to the type carrying belts 1. The hammer 5 functions to depress a paper 6 toward the type 3 when a desired type appears at a position confronting the hammer 5.

The ink is supplied to every type 3 by the ink roller 2 without regard to the selection of the types 3 and, therefore, there is a possibility that a type 3 of the digit adjacent to a selected type 3, unto which the hammer 5 is impacted, may accidentally come into contact with the paper 6. This will deteriorate the print quality.

To avoid the above defects, in the conventional hammer actuated printer, separator leaves 7 are provided at positions corresponding to respective spaces provided between adjacent two type carrying belts 1 in order to separate the type carrying belts 1 from each other. The separator leaves 7 are discrete from the printing drum 4, and are disposed between the printing drum 4 and the paper 6 in such a manner that the paper 6 does not come into contact with the types 3 unless the paper 6 is depressed by the hammer 5.

In order to ensure accurate printing operation, the edges of the separator leaves 7 must be located at positions higher than the type surface by a uniform length, for example, 0.2 mm through 0.3 mm. The uniformity of the separator leaves 7 is essential for performing clean printing, although it is very difficult to accurately position the separator leaves 7.

Figure 3:
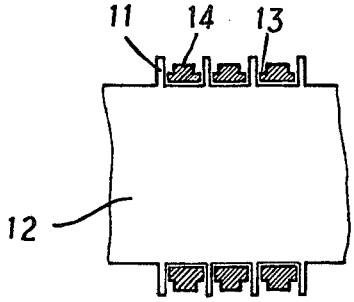
FIG. 3 is a sectional view of a printing drum, separator strips and type carrying belts employed in an embodiment of a hammer actuated printer of the present invention.

FIG. 3 shows an essential part of the hammer actuated printer of the present invention.

A plurality of separator strips 11 are formed on the periphery of a printing drum 12 in such a manner that a plurality of type carrying belts 13 are separated from each other. The type carrying belts 13 carry a plurality of types 14 formed thereon, respectively. The separator strips 11 are integral with the printing drum 12, and have a height higher than that of the types 14 formed on the type carrying belts 13 by 0.2 mm through 0.3 mm.

Figure 4:
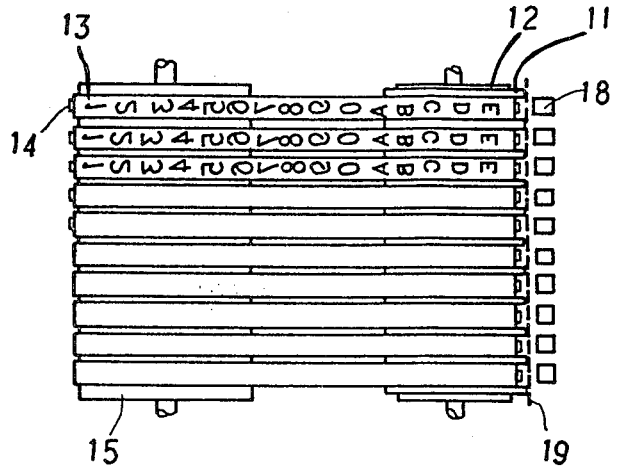
FIG. 4 is a plan view of an essential part of an embodiment of a hammer actuated printer of the present invention.
Figure 5:
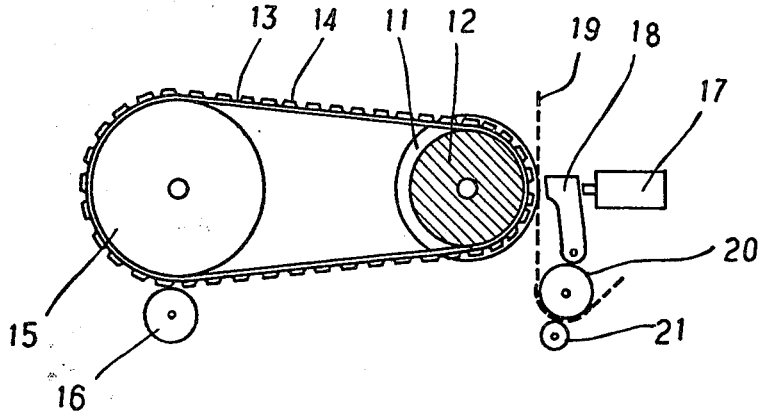
FIG. 5 is a side view of the hammer actuated printer of FIG. 4.

FIGS. 4 and 5 show an essential part of an embodiment of the hammer actuated printer of the present invention. Like elements corresponding to those of FIG. 3 are indicated by like numerals.

An idler pulley 15 is provided in parallel with the printing drum 12. The type carrying belts 13 extend between the printing drum 12 and the idler pulley 15, and are driven to circulate for printing purposes. An ink roller 16 is provided below the idler pulley 15 so that the types 14 formed on the type carrying belts 13 are covered with ink during the rotation of the type carrying belts 13.

A plurality of hammers 18 are provided in such a manner as to face the type carrying belts 13 at the printing drum 12. The respective hammers 18 are driven to depress a paper 19 toward the printing drum 12 by corresponding hammer actuating solenoids 17 when a selected type 14 appears at a predetermined position. The paper 19 is driven to travel by a paper feed mechanism including a paper feed roller 20 and a depression roller 21 when one line printing is completed.

Since the separator strips 11 are formed on the periphery of the printing drum 12, the location of the separator strips 11 can be exactly controlled and the height of the separator strips 11 can be uniformly controlled. Moreover, the mechanism of the printer and the fabrication of the printer can be simplified when the separator strips 11 are integrally formed on the drum surface.

The invention being thus described, it will be obvious that the same may be varied in many ways. Such variations are not to be regarded as a departure from the spirit and scope of the invention, and all such modifications are intended to be included within the scope of the following claims.

What is claimed is:

1. A printer comprising a printing drum, a plurality of type carrying belts secured on said printing drum, a plurality of types carried by the respective type carrying belts, a print receiving member, and a plurality of hammers for depressing said print receiving member toward said printing drum when a selected type appears at a predetermined position, comprising:

a plurality of separator strips formed on the periphery of said printing drum for separating said plurality of type carrying belts from each other, said separator strips extending upwardly from the surface of said printing drum beyond the outer extremity of the types on said type carrying belts;

an idler pulley operatively disposed adjacent to and substantially parallel with said printing drum, said plurality of type carrying belts extending between said idler pulley and said printing drum;

an ink roller operatively disposed adjacent to said idler pulley for coating said types with ink; and said hammers being operatively positioned to depress said print receiving member towards said printing drum and between said separator strips to impart an image of the types thereto;

whereby said spacing strips being shaped and spaced to prevent said print receiving member from accidentally impinging upon said types while protecting the surface of said print receiving member when depressed by said hammers, and said ink roller supplying ink to said types adjacent said idler pulley to prevent linking of said spacing strips.

2. The printer of claim 1, wherein said separator strips are higher than the types carried by said type carrying belts by 0.2 mm through 0.3 mm.

3. The printer of claim 1, wherein said separator strips are integral with said printing drum.

* * * * *